US010000831B2

(12) United States Patent
Park et al.

(10) Patent No.: US 10,000,831 B2
(45) Date of Patent: Jun. 19, 2018

(54) HIGHLY DURABLE COIL SPRING STEEL

(71) Applicants: Hyundai Motor Company, Seoul (KR); Hyundai Steel Company, Incheon (KR)

(72) Inventors: Jeen Woo Park, Gyeonggi-do (KR); Sung Chul Cha, Seoul (KR); Jong Hwi Park, Gyeonggi-do (KR); Kyu Ho Lee, Gyeonggi-do (KR)

(73) Assignees: Hyundai Motor Company, Seoul (KR); Hyundai Steel Company, Incheon (KR)

( * ) Notice: Subject to any disclaimer, the term of this patent is extended or adjusted under 35 U.S.C. 154(b) by 125 days.

(21) Appl. No.: 15/151,755

(22) Filed: May 11, 2016

(65) Prior Publication Data

US 2017/0167004 A1 Jun. 15, 2017

(30) Foreign Application Priority Data

Dec. 15, 2015 (KR) ..... 10-2015-0178856

(51) Int. Cl.

| | |
|---|---|
| ***C22C 38/46*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |

(52) U.S. Cl.

CPC ..... *C22C 38/46* (2013.01); *C22C 38/002* (2013.01); *C22C 38/02* (2013.01); *C22C 38/04* (2013.01); *C22C 38/42* (2013.01)

(58) Field of Classification Search

CPC ..... C22C 38/46; C22C 38/42; C22C 38/04; C22C 38/02

USPC ..... 420/91

See application file for complete search history.

(56) References Cited

U.S. PATENT DOCUMENTS

2010/0224287 A1* 9/2010 Kochi et al. ..... 148/504

FOREIGN PATENT DOCUMENTS

| | | | |
|---|---|---|---|
| JP | 2006-183137 | A | 7/2006 |
| JP | 2009-068030 | A | 4/2009 |
| JP | 2011-080105 | A | 4/2011 |
| JP | 2014-101569 | A | 6/2014 |
| KR | 2007-0005013 | A | 1/2007 |
| KR | 10-2008-0060210 | A | 9/2008 |
| KR | 2010-0077250 | A | 7/2010 |
| KR | 2012-0133746 | A | 12/2012 |
| KR | 10-2015-0002848 | A | 1/2015 |
| KR | 2015-0078190 | A | 7/2015 |

* cited by examiner

*Primary Examiner* — Edward Johnson

(74) *Attorney, Agent, or Firm* — Mintz Levin Cohn Ferris Glovsky and Popeo, P.C.; Peter F. Corless

(57) ABSTRACT

Disclosed are a steel composition and a spring steel comprising the same. The steel composition comprises: an amount of about 0.51 to 0.57% by weight of carbon (C), an amount of about 1.35 to 1.45% by weight of silicon (Si), an amount of about 0.95 to 1.05% by weight of manganese (Mn), an amount of about 0.60 to 0.80% by weight of chromium (Cr), an amount of about 0.25 to 0.35% by weight of copper (Cu), an amount of about 0.05 to 0.15% by weight of vanadium (V), an amount of about 0.25 to 0.35% by weight of nickel (Ni), an amount of about 0.003 to 0.015% by weight of phosphorus (P), an amount of about 0.003 to 0.010% by weight of sulfur (S), and iron (Fe) constituting the remaining balance of the steel composition, all the % by weights are based on the total weight of the steel composition.

7 Claims, 21 Drawing Sheets

HIGHLY DURABLE COIL SPRING STEEL

CROSS-REFERENCE TO RELATED APPLICATION

This application claims the priority benefit of Korean Patent Application No. 10-2015-0178856, filed on Dec. 15, 2015 in the Korean Intellectual Property Office, the disclosure of which is incorporated herein by reference.

TECHNICAL FIELD

The present invention relates to a steel composition and a coil spring steel comprising the same, thereby improving corrosion resistance and increased tensile strength the coil spring steel. The steel composition may comprise silicon (Si), manganese (Mn), phosphorus (P), and sulfur (S).

BACKGROUND

Coil springs applied to vehicles have been produced with a high stress of about 120 K in a recent vehicle industry. For example, the coil springs with a high stress of about 130 K have been also massively applied to vehicles. In addition, as a material with a high strength of 110 K to 130 K has been generally applied, the thickness of wire/the number of coil turns may be decreased and thus the weight of vehicles may be reduced. However, after chipping/painting exfoliation, sensitivity to corrosion may increase. In addition, design margin may not be secured due to thickness decrease of the wire, whereby there are risks such as strength deficiency and progression speed acceleration until being reached complete breakage during breakage progress.

In the related arts, in order to reduce such risks, dual coating or the like has been applied only to some parts vulnerable to corrosion. However, excessive material (paint) cost may increase and a fundamental solution may not be provided. Accordingly, durability increase through enhancement of such strength/corrosion problems of a material is a problem that the current vehicle industry must solve. Recently, since vehicles have high performance, high output and high efficiency, high strengthening and weight reduction of components are required. In addition, since steel materials for a suspension should be weight-reduced under conventional vehicle load/corrosion conditions, rigidity and durability of a material should be essentially secured.

The above disclosed background art has been provided to aid in understanding of the present invention and should not be interpreted as conventional technology known to a person having ordinary skill in the art

SUMMARY OF THE INVENTION

In preferred aspects, the present invention provides a steel composition and a coil spring steel comprising the same. The coil spring may have improved corrosion resistance and tensile strength using the steel composition which may suitably comprise the contents of silicon (Si), manganese (Mn), phosphorus (P), and sulfur (S).

In one aspect, the present invention provides a steel composition that may comprise: an amount of about 0.51 to 0.57% by weight of carbon (C), an amount of about 1.35 to 1.45% by weight of silicon (Si), an amount of about 0.95 to 1.05% by weight of manganese (Mn), an amount of about 0.60 to 0.80% by weight of chromium (Cr), an amount of about 0.25 to 0.35% by weight of copper (Cu), an amount of about 0.05 to 0.15% by weight of vanadium (V), an amount of about 0.25 to 0.35% by weight of nickel (Ni), an amount of about 0.003 to 0.015% by weight of phosphorus (P), an amount of about 0.003 to 0.010% by weight of sulfur (S), and iron (Fe) constituting the remaining balance of the steel composition. Unless otherwise indicated, all the % by weights are based on the total weight of the steel composition.

The present invention also provides the steel composition that may consist essentially of, essentially consist of, or consist of the components as described herein. For instance, the steel composition may consist essentially of, essentially consist of, or consist of: an amount of about 0.51 to 0.57% by weight of carbon (C), an amount of about 1.35 to 1.45% by weight of silicon (Si), an amount of about 0.95 to 1.05% by weight of manganese (Mn), an amount of about 0.60 to 0.80% by weight of chromium (Cr), an amount of about 0.25 to 0.35% by weight of copper (Cu), an amount of about 0.05 to 0.15% by weight of vanadium (V), an amount of about 0.25 to 0.35% by weight of nickel (Ni), an amount of about 0.003 to 0.015% by weight of phosphorus (P), an amount of about 0.003 to 0.010% by weight of sulfur (S), and iron (Fe) constituting the remaining balance of the steel composition, all the % by weights are based on the total weight of the steel composition.

In another aspect, the present invention provides a coil spring steel that may comprise the steel composition as described herein.

The coil spring steel may have a general fatigue life of about 750,000 or greater under a repeated stress condition of up to about 120 kgf/mm$^2$ when subjected to a general fatigue life test after molding of a spring.

The coil spring steel may have a corrosion fatigue life of about 500,000 times or greater under conditions of salt water-spraying and a repeated stress of up to about 60 kgf/mm$^2$ when subjected to a corrosion fatigue life test after molding of a spring.

The coil spring steel may have an outermost-surface ferrite decarbonization depth of about 1 μm or less.

Further provided is a vehicle part that may comprise a steel composition as described herein. Also provided is a vehicle that may comprise the vehicle part comprising the steel composition as described herein.

Other aspects of the invention are disclosed infra.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
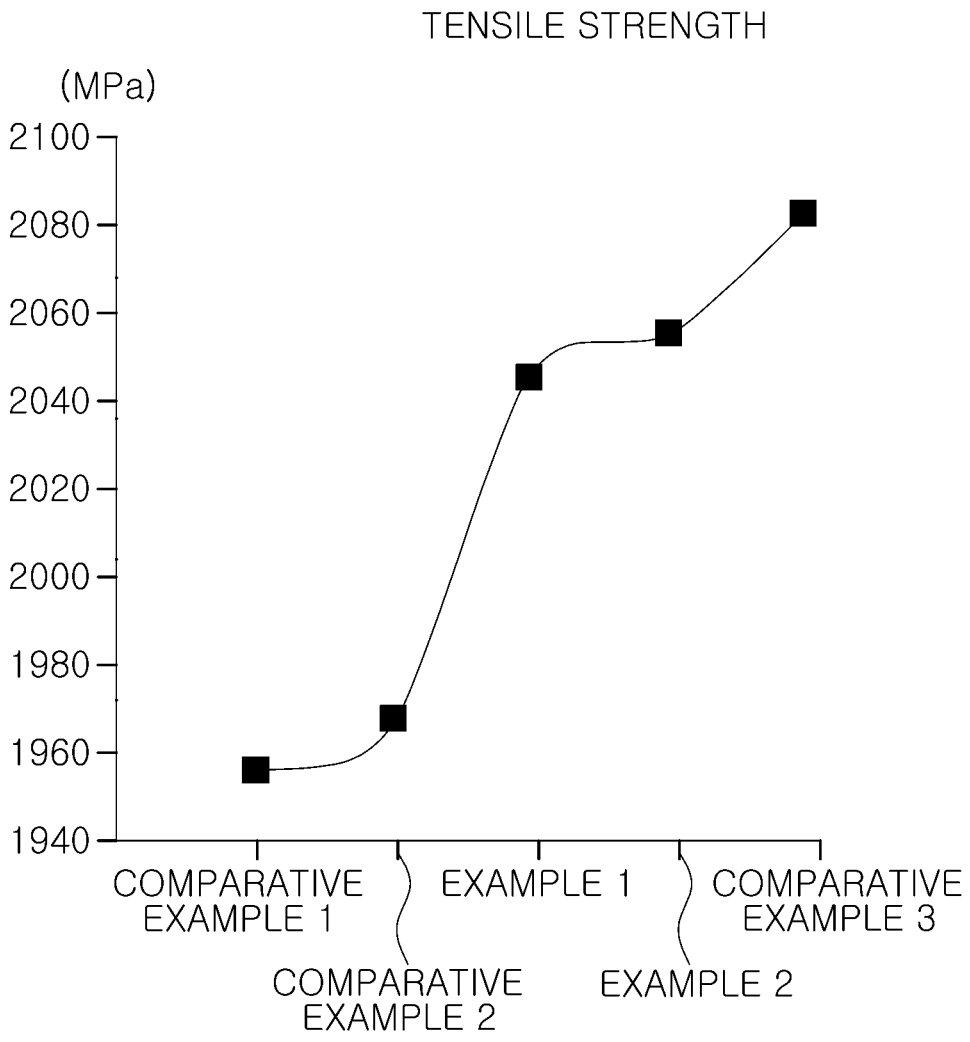
FIG. 1 is a graph showing a tensile strength of Examples according to an exemplary embodiment of the present invention and Comparative Examples dependent upon the content of silicon (Si)

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Reference will now be made in detail to various exemplary embodiments of the present invention, examples of which are illustrated in the accompanying drawings. Wherever possible, the same reference numbers will be used throughout the drawings to refer to the same or like parts.

The steel according to the present invention provides a highly durable coil spring. The steel composition may comprise: an amount of about 0.51 to 0.57% by weight of carbon (C), an amount of about 1.35 to 1.45% by weight of silicon (Si), an amount of about 0.95 to 1.05% by weight of manganese (Mn), an amount of about 0.60 to 0.80% by weight of chromium (Cr), an amount of about 0.25 to 0.35% by weight of copper (Cu), an amount of about 0.05 to 0.15% by weight of vanadium (V), an amount of about 0.25 to 0.35% by weight of nickel (Ni), an amount of about 0.003 to 0.015% by weight of phosphorus (P), an amount of about 0.003 to 0.010% by weight of sulfur (S), and iron (Fe) constituting the remaining balance of the steel composition, all the % by weights are based on the total weight of the steel composition.

Hereinafter, steel components and contents thereof for the highly durable coil spring steel according to the present disclosure will be described in detail.

Carbon (C) in Content of about 0.51 to 0.57% by Weight

Carbon (C) as used herein may most effectively increase the strength of steel. Carbon (C) may form austenite such as martensite tissue. As the carbon content increases, toughness may be decreased and hardness may be increased. Carbon (C) may bind or alloy with metallic element such as iron (Fe), chromium (Cr), or vanadium (V) to form a carbide, thereby increasing strength and hardness.

When the carbon (C) is added in an amount of less than about 0.51% by weight, tensile strength and fatigue strength may be decreased. On the other hand, when carbon (C) is added in an amount of greater than about 0.57% by weight, toughness may be decreased, accordingly, for example, before quenching, hardness may increase and machinability may be decreased. Therefore, the content of carbon (C) may range from about 0.51 to about 0.57% by weight based on the total weight of the steel composition.

Silicon (Si) in Content of about 1.35 to 1.45% by Weight

Silicon (Si) as used herein may increase hardness and strength of steel and may strengthen a pearlite phase, but may reduce elongation and an impact value. Silicon (Si) may be reactive with oxygen.

When silicon (Si) is added in an amount of less than about 1.35% by weight, tensile strength and fatigue strength may be decreased. On the other hand, when silicon (Si) is added in an amount of greater than about 1.45% by weight, fatigue strength may be decreased due to decarbonization, and machinability may be decreased due to hardness increase before quenching. Therefore, the content of silicon (Si) may range from about 1.35 to about 1.45% by weight based on the total weight of the steel composition.

Manganese (Mn) in Content of about 0.95 to 1.0 5% by Weight

Manganese (Mn) as used herein may increase hardenability and strength of steel during quenching. However, when a greater amount of manganese (Mn) than the predetermined amount is included, quenching cracks, thermal strain, and decrease in toughness may be induced. When manganese (Mn) may react with sulfur (S) to form an inclusion, e.g., MnS.

When manganese (Mn) is added in an amount of less than about 0.95% by weight, hardenability of steel may not be improved sufficiently. On the other hand, when manganese (Mn) is added in an amount of greater than about 1.05% by weight, machinability and toughness may be decreased, and fatigue life may be decreased due to deposition according to excessively generated MnS. Therefore, the content of manganese (Mn) may range from about 0.95 to about 1.05% by weight based on the total weight of the steel composition.

Chromium (Cr) in Content of about 0.60 to 0.80% by Weight

Chromium (Cr) as used herein may improve hardenability as being dissolved in austenite, and suppress softening resistance during tempering. Chromium (Cr) may be added to complement mechanical properties such as hardenability and strength. In addition, chromium (Cr) may prevent decarbonization of high-silicon (Si) steel.

When chromium (Cr) is added in an amount of less than about 0.60% by weight, the strength of steel may be decreased, and thus, the steel may be permanently deformed. On the other hand, when chromium (Cr) is added in an amount of greater than about 0.80% by weight, hardness of steel may be increased, but toughness of steel may be decreased, thereby generating cracks on steel and increasing production costs. Therefore, the content of chromium (Cr) may range from about to about 0.80% by weight based on the total weight of the steel composition.

Copper (Cu) in Content of about 0.25 to 0.35% by Weight

Copper (Cu) as used herein may provide corrosion from progressing inside steel by increasing densification of a corrosion oxide on a steel surface. However, when a greater amount of copper (Cu) than the predetermined amount is included, fine cracks may be generated at steel due to brittleness (red shortness) at high temperature.

When copper (Cu) is added in an amount of less than about 0.25% by weight, corrosion resistance may be decreased, and thus, corrosion and fatigue life of steel may be decreased. On the other hand, when copper (Cu) is added in an amount of greater than about 0.35%, cracks may be generated due to brittleness (red shortness) at high temperature and production costs may increase. Therefore, the content of copper (Cu) may range from about 0.25 to about 0.35% by weight based on the total weight of the steel composition.

Vanadium (V) in Content of about 0.05 to 0.15% by Weight

Vanadium (V) may prevent coarsening of a grain size due to formation of minute precipitates at high temperature by refining tissue. Through such tissue refinement, strength may be increased and toughness may be secured. However, when vanadium (V) is included in a greater amount than the predetermined amount, precipitates are coarsened, and thus, toughness and fatigue life may be decreased.

When vanadium (V) is included in an amount of less than about 0.05% by weight, strength may be decreased and grain sizes may be coarsened. On the other hand, when vanadium (V) is included in an amount of greater than about 0.15% by weight, toughness and fatigue life may be decreased and production costs may increase. Therefore, the content of vanadium (V) may range from about 0.05 to about 0.15% by weight based on the total weight of the steel composition.

Nickel (Ni) in Content of about 0.25 to 0.35% by Weight

Since nickel (Ni) as used herein may refine steel tissue and is easily employed in austenite, the nickel may be used in matrix strengthening. Nickel (Ni) may have superior hardenability and provide, particularly, corrosion resistance enhancement effects.

When nickel (Ni) is included in an amount of less than about 0.25% by weight, corrosion resistance may be decreased, and thus, corrosion and fatigue life of steel may be decreased. On the other hand, when nickel (Ni) is included in an amount of greater than about 0.35% by weight, production costs may increase. Therefore, the content of nickel (Ni) may range from about 0.25 to about 0.35% by weight based on the total weight of the steel composition.

Phosphorus (P) in Content of about 0.003 to 0.015% by Weight

When phosphorus (P) is uniformly distributed in steel, machinability may be enhanced without particular problems.

When phosphorus (P) is included in an amount of less than about 0.003% by weight, machinability may be decreased. On the other hand, when phosphorus (P) is included in an amount of greater than about 0.015% by weight, impact resistance may be decreased and tempering brittleness may be facilitated. Therefore, the content of phosphorus (P) may range from about 0.003 to about 0.015% by weight based on the total weight of the steel composition.

Sulfur (S) in Content of about 0.003 to 0.010% by Weight

Sulfur (S) as used herein may increase machinability of steel by forming an inclusion, e.g., MnS, through reaction with manganese (Mn).

When sulfur (S) is included in an amount of less than 0.0036% by weight, machinability may be decreased. On the other hand, when sulfur (S) is included in an amount of greater than about 0.010% by weight, fatigue life may be decreased using MnS as a base point for cracks. Therefore, the content of sulfur (S) may range from about 0.003 to about 0.010% by weight based on the total weight of the steel composition.

Example

Hereinafter, (material/composition) according to an exemplary embodiment of the present invention will be described with reference to the accompanying drawings.

Examples and Comparative Examples

Effects depending upon control of the content of silicon (Si) are particularly described in the following Table 1 and FIGS. 1 to 6 below.

Figure 5:
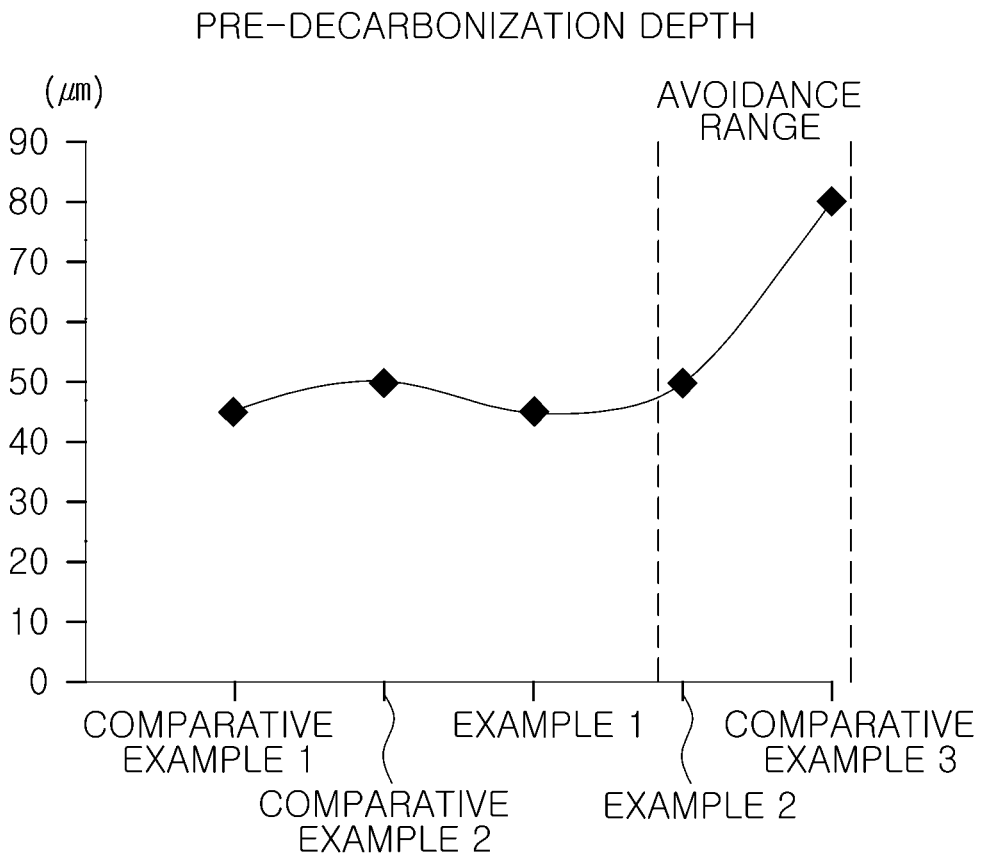
FIG. 5 is a graph showing pre-decarbonized depths of Examples according to an exemplary embodiment of the present invention and Comparative Examples dependent upon the content of silicon (Si)

As illustrated in FIG. 5, a pre-decarbonization depth was maintained at 40 to 50 μm when the content of silicon (Si) was 1.35 to 1.45% by weight based on the total weight of the steel composition, but rapidly increased from between 1.45% and 1.53% by weight. The pre-decarbonization depth means a depth in which hardness is decreased while carbon of a coil spring steel is lost by heat treatment. This means that fatigue life and corrosion fatigue life of a coil spring may be further decreased with increasing pre-decarbonization depth.

The pre-decarbonization depth was measured using a hardness method. A depth from a surface to a point in which hardness rapidly increased was a pre-decarbonization depth.

TABLE 1

| | Classification | | | | | | | | |
|---|---|---|---|---|---|---|---|---|---|
| | Carbon (C) % by weight | Silicon (Si) % by weight | Manganese (Mn) % by weight | Chromium (Cr) % by weight | Copper (Cu) % by weight | Vanadium (V) % by weight | Nickel (Ni) % by weight | Phosphorus (P) % by weight | Sulfur (S) % by weight |
| Comparative Example 1 | 0.54 | 1.14 | 0.99 | 0.73 | 0.29 | 0.11 | 0.29 | 0.018 | 0.010 |
| Comparative Example 2 | 0.55 | 1.27 | 1.01 | 0.73 | 0.28 | 0.11 | 0.28 | 0.017 | 0.012 |
| Example 1 | 0.54 | 1.35 | 1.00 | 0.74 | 0.29 | 0.10 | 0.28 | 0.019 | 0.010 |
| Example 2 | 0.56 | 1.45 | 0.99 | 0.71 | 0.29 | 0.11 | 0.27 | 0.018 | 0.011 |
| Comparative Example 3 | 0.54 | 1.53 | 1.01 | 0.72 | 0.27 | 0.09 | 0.29 | 0.017 | 0.012 |

As summarized in Table 1, in comparative examples and examples, only silicon (Si) was a control variable and the other elements were controlled in equal degrees, within a predetermined range, to components of highly durable spring steel according to the present invention.

Since the content of silicon (Si) was in an amount of 1.35 to 1.45% by weight, the contents of silicon (Si) in Comparative Examples 1 and 2 were less than 1.35% by weight. The content of silicon (Si) in Comparative Example 3 was greater than 1.45% by weight.

Figure 2:
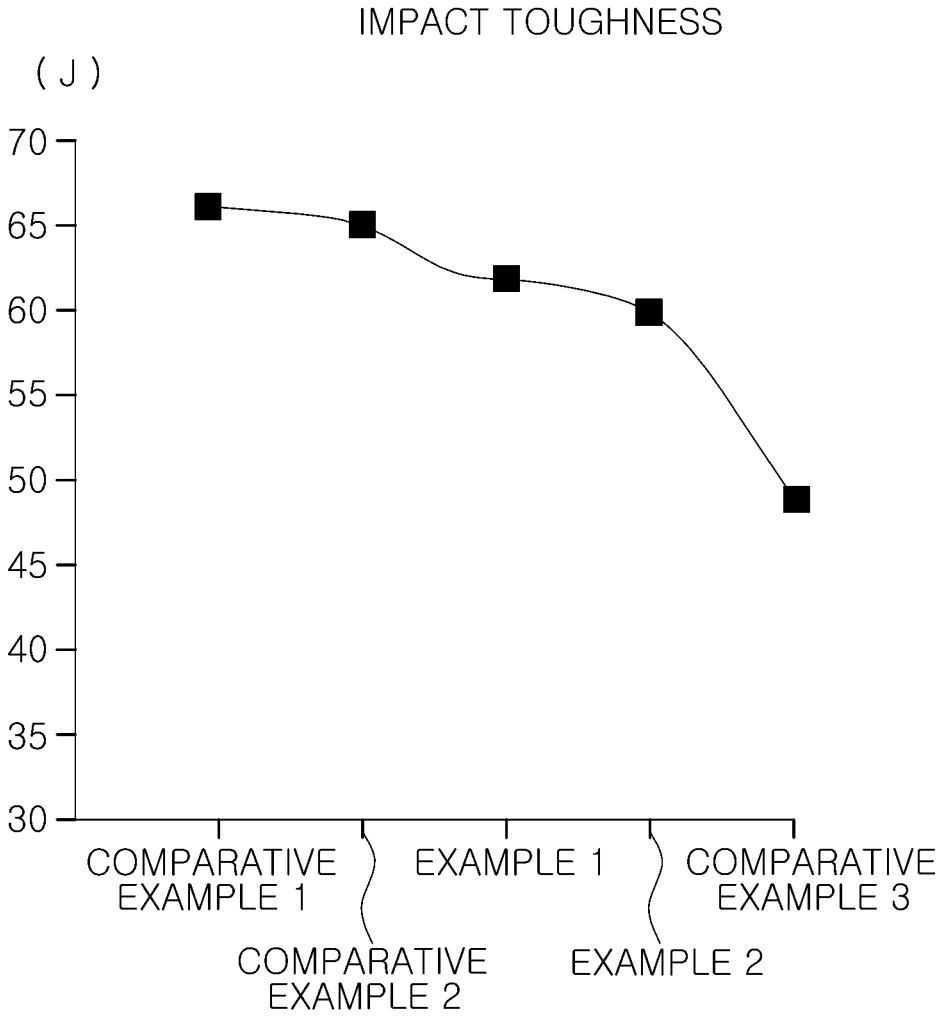
FIG. 2 is a graph showing an impact toughness of Examples according to an exemplary embodiment of the present invention and Comparative Examples dependent upon the content of silicon (Si)
Figure 3:
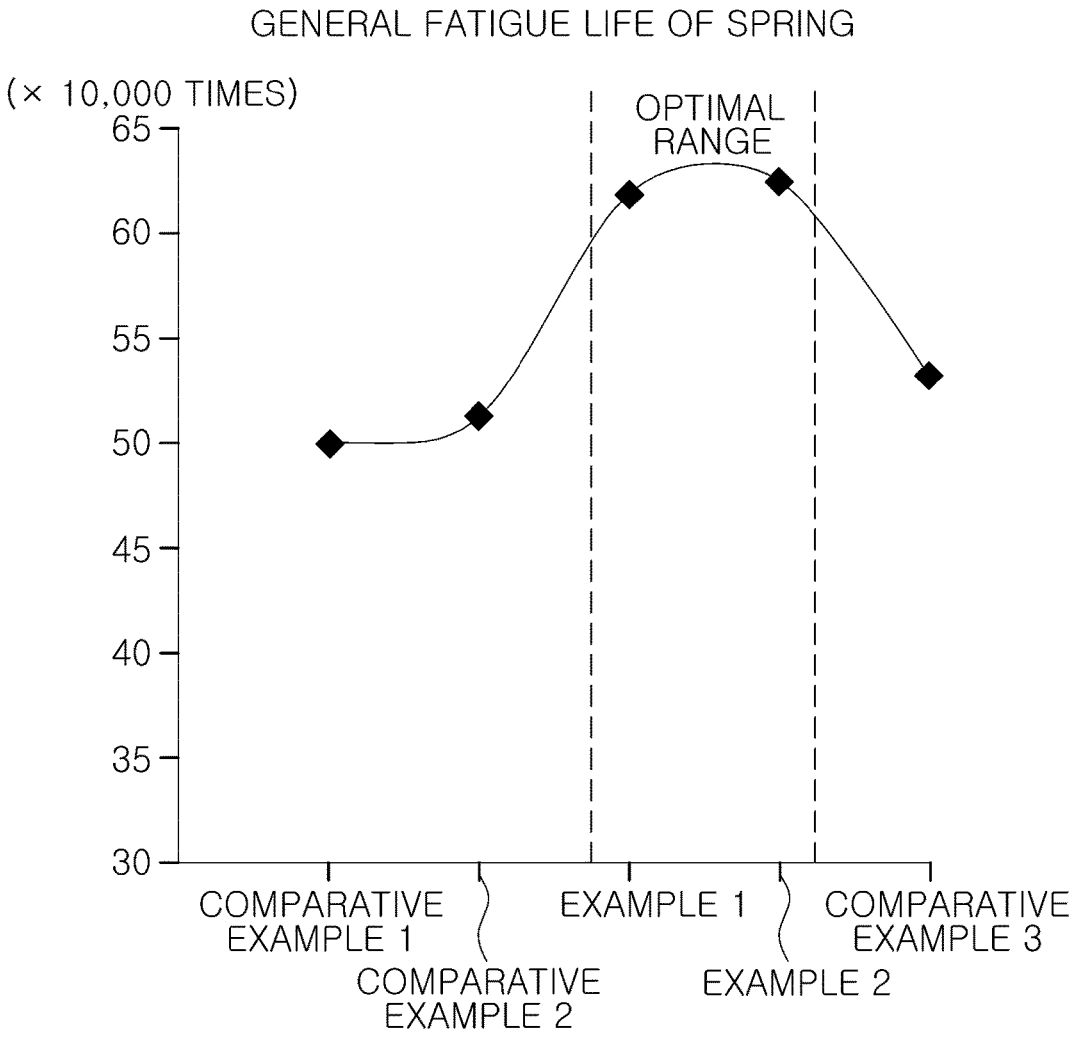
FIG. 3 is a graph showing a general fatigue life of coil springs from Examples according to an exemplary embodiment of the present invention and Comparative Examples dependent upon the content of silicon (Si)

As illustrated in FIGS. 1 and 3, tensile strength and general fatigue life of a spring increased together with increasing silicon (Si) content. However, as illustrated in FIG. 2, impact toughness was decreased with increasing silicon (Si) content and, particularly, rapidly decreased from between 1.45% by weight and 1.53% by weight.

Tensile strength was measured using a standard tensile test piece. Impact toughness was measured using a standard impact test piece.

In addition, the general fatigue life of coil spring steel was measured by means of a fatigue test device only for a spring to evaluate lifespan under a repeated stress of 20 to 120 kgf/mm$^3$.

Figure 4:
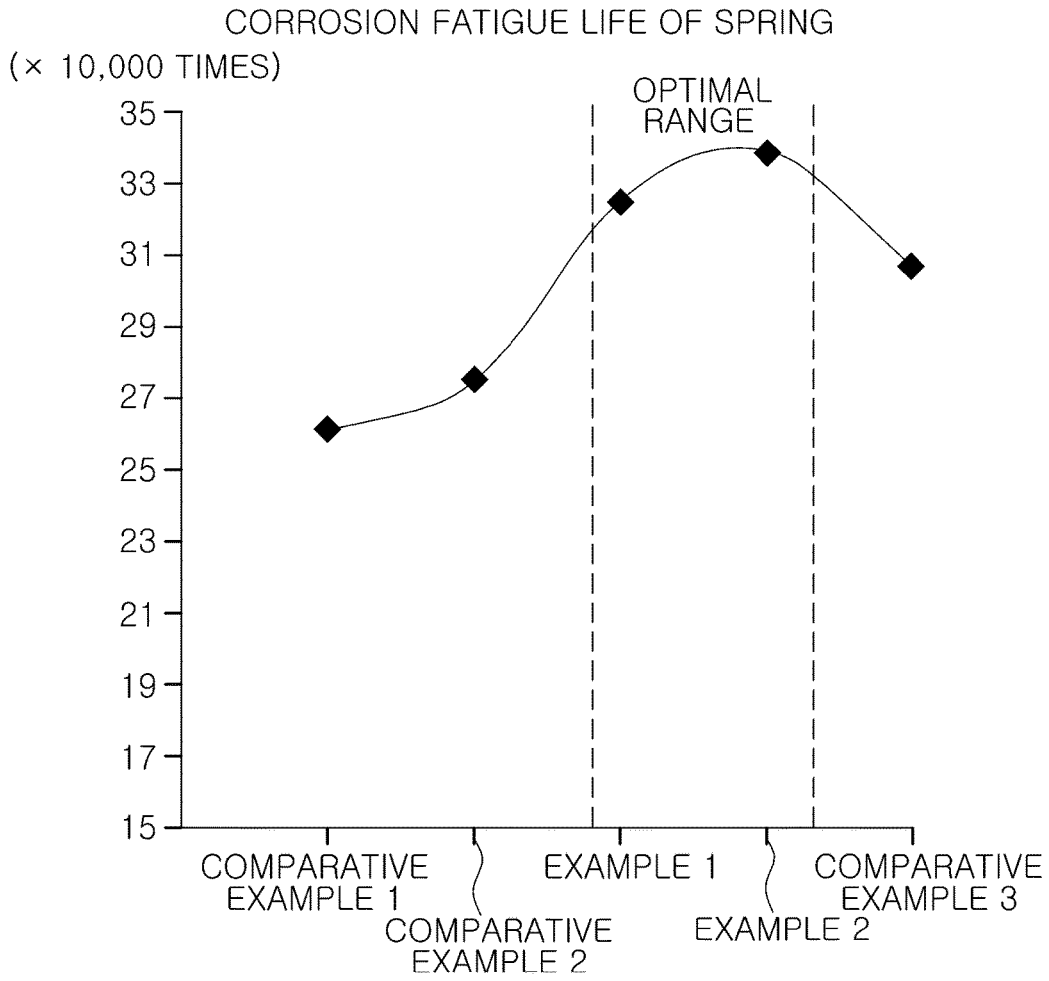
FIG. 4 is a graph showing a corrosion fatigue life of oil springs from Examples according to an exemplary embodiment of the present invention and Comparative Examples dependent upon the content of silicon (Si)

As illustrated in FIG. 4, it can be confirmed that corrosion fatigue life of a spring was suitably obtained in a silicon (Si) content range of 1.35 to 1.45% by weight based on the total weight of the steel composition. Accordingly, corrosion fatigue life of the spring was also decreased in a range, i.e., between 1.45% and 1.53% by weight, in which impact toughness was rapidly decreased due to notch effects for a corroded groove.

Figure 6:
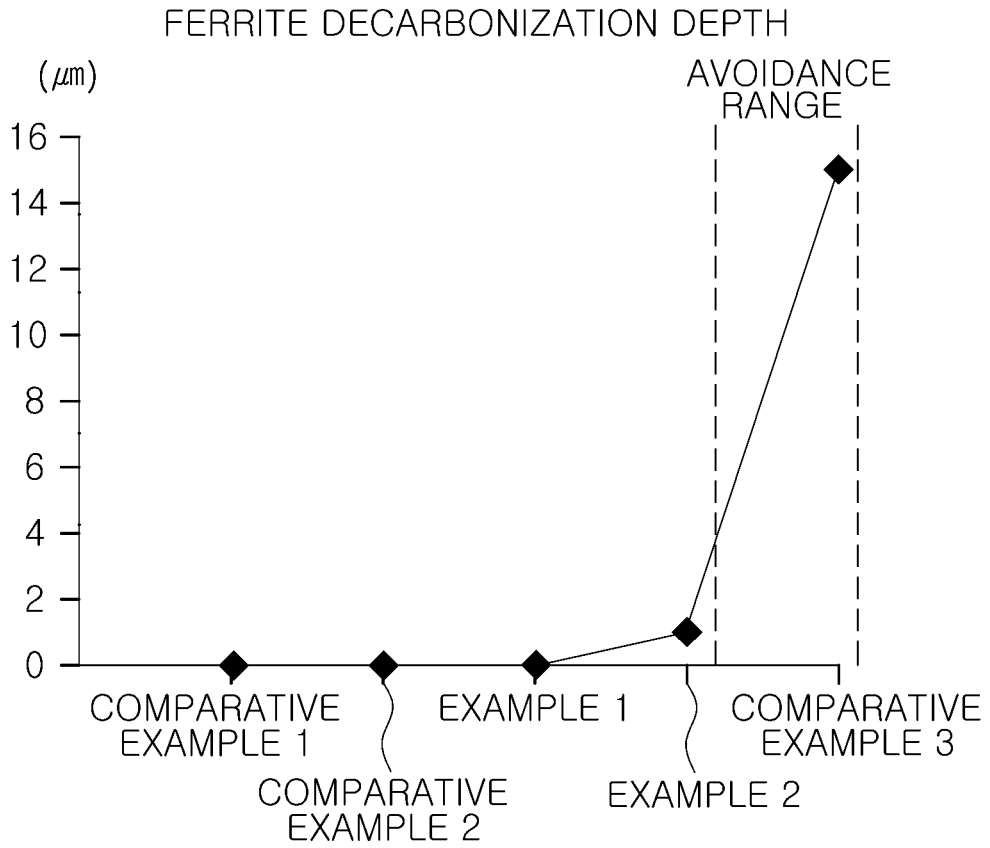
FIG. 6 is a graph showing ferrite decarbonization depths of Examples according to an exemplary embodiment of the present invention and Comparative Examples dependent upon the content of silicon (Si)

Meanwhile, as illustrated in FIG. 6, a ferrite decarbonization depth was maintained at 1 μm or less until the content of silicon (Si) was 1.35 to 1.45% by weight based on the total weight of the steel composition, but rapidly increased from between 1.45% by weight and 1.53% by weight. The ferrite decarbonization depth means the depth of white ferrite tissue exhibited when carbon on a surface of coil spring steel is greatly lost. General fatigue life and corrosion fatigue life are greatly affected until the ferrite decarbonization depth is 1 μm or less, but general fatigue life and corrosion fatigue life of a coil spring may be decreased, as the pre-decarbonization depth, when the ferrite decarbonization depth is greater than 1 μm.

Figure 21:
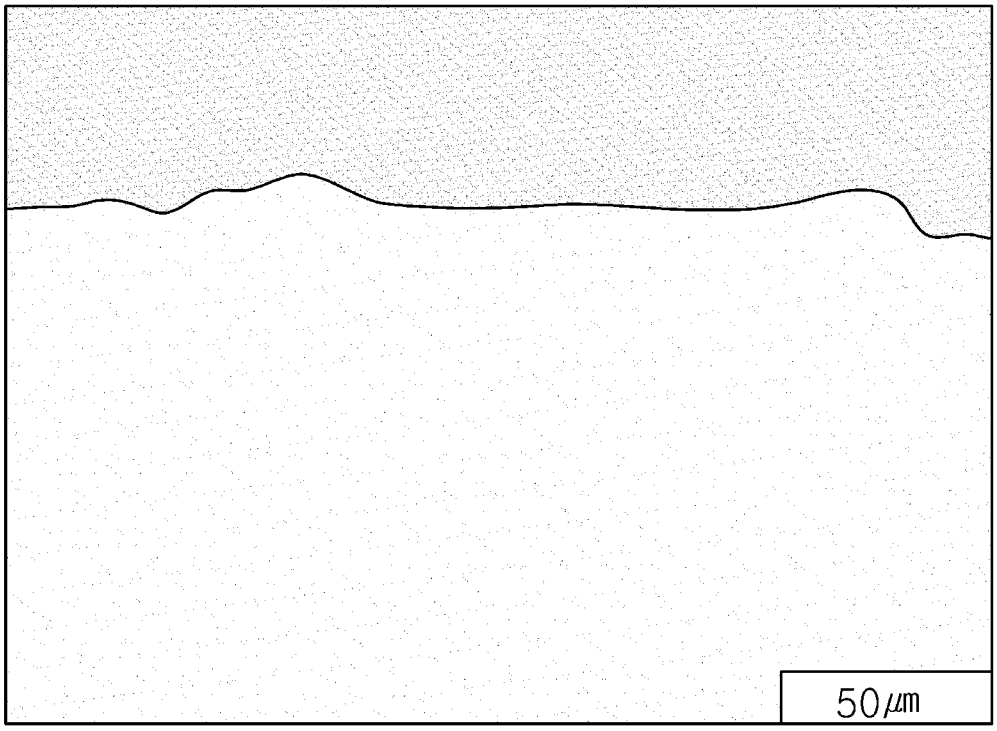
FIG. 21 is a photograph showing an exemplary ferrite tissue of an exemplary steel composition according to an exemplary embodiment of the present invention.

The ferrite decarbonization depth was measured using a microscopy. A cross section of the coil spring steel was photographed by means of a microscope to measure the depth of white ferrite tissue. As illustrated in FIG. 21, it can be confirmed that a white ferrite decarbonization depth was formed in a depth of 1 μm or less and thus white ferrite tissue was not clearly observed.

For this reason, the content of silicon (Si) may be of about 1.35 to 1.45% by weight based on the total weight of the steel composition.

The corrosion fatigue life of coil spring steel was measured by means of a fatigue test device only for a spring for measuring lifespan under a repeated stress of 20 to 60 kgf/mm$^3$ while spraying an aqueous NaCl solution at concentration of 5±0.5% at a temperature of 35° C.

Effects according to control of the content of manganese (Mn) are discussed in detail and summarized in the following Table 2 and FIGS. 7 to 10 below.

TABLE 2

| | Classification | | | | | | | | |
|---|---|---|---|---|---|---|---|---|---|
| | Carbon (C) % by weight | Silicon (Si) % by weight | Manganese (Mn) % by weight | Chromium (Cr) % by weight | Copper (Cu) % by weight | Vanadium (V) % by weight | Nickel (Ni) % by weight | Phosphorus (P) % by weight | Sulfur (S) % by weight |
| Comparative Example 4 | 0.55 | 1.41 | 0.82 | 0.72 | 0.28 | 0.10 | 0.28 | 0.019 | 0.011 |
| Comparative Example 5 | 0.53 | 1.39 | 0.87 | 0.72 | 0.29 | 0.12 | 0.29 | 0.019 | 0.011 |
| Example 2 | 0.55 | 1.39 | 0.95 | 0.71 | 0.29 | 0.10 | 0.29 | 0.018 | 0.012 |
| Example 3 | 0.55 | 1.40 | 1.05 | 0.72 | 0.28 | 0.09 | 0.30 | 0.017 | 0.013 |
| Comparative Example 6 | 0.53 | 1.41 | 1.17 | 0.73 | 0.29 | 0.11 | 0.29 | 0.018 | 0.011 |

As summarized in Table 2, only manganese (Mn) was a control variable and the other elements were controlled in equal degrees, within a predetermined range, to components of the highly durable coil spring steel according to the present invention in comparative examples and examples.

Since the content of manganese (Mn) was limited to 0.95 to 1.05% by weight, the contents of manganese (Mn) in Comparative Examples 4 and 5 were less than 0.95% by weight. The content of manganese (Mn) in Comparative Example 6 was greater than 1.05% by weight.

Figure 7:
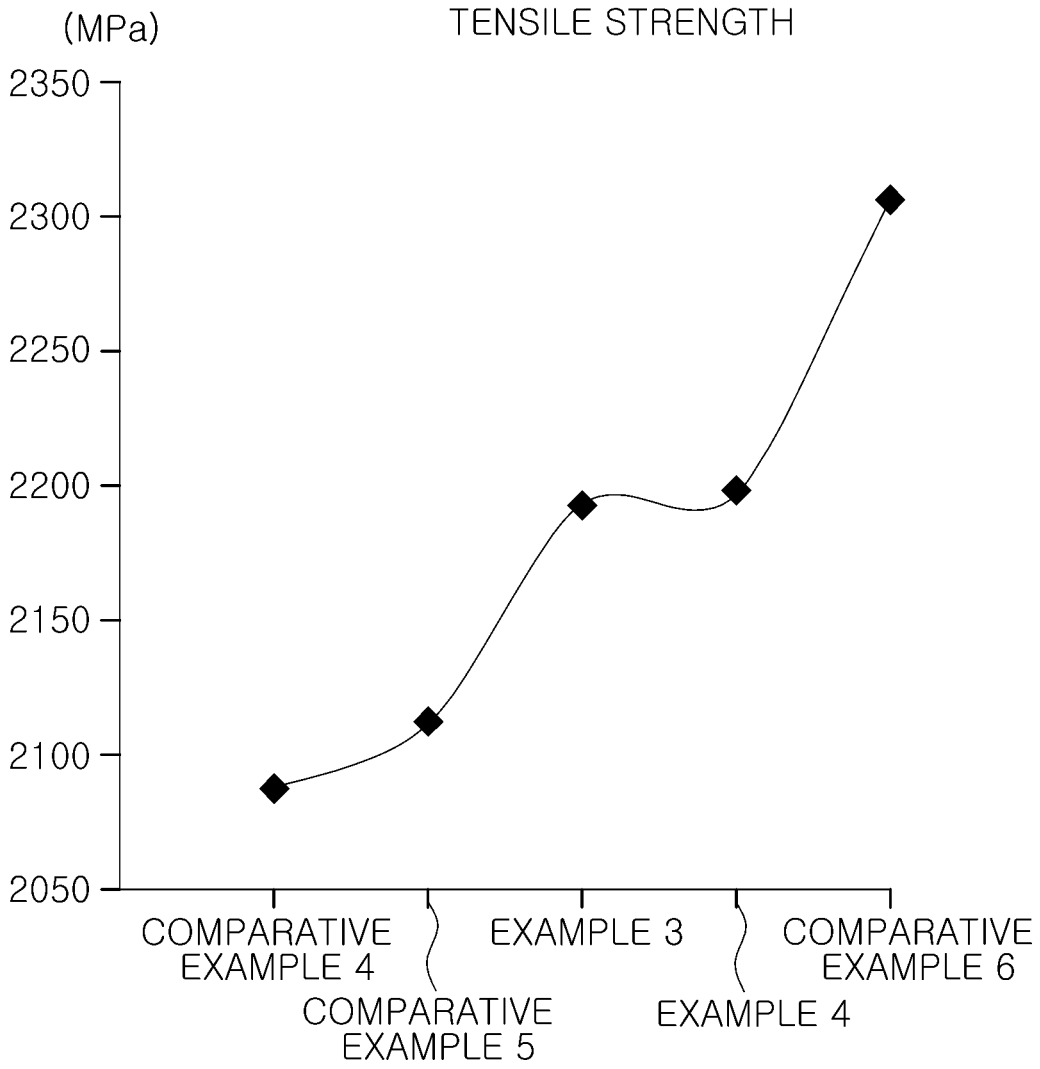
FIG. 7 is a graph showing a tensile strength of Examples according to an exemplary embodiment of the present invention and Comparative Examples dependent upon the content of manganese (Mn)
Figure 8:
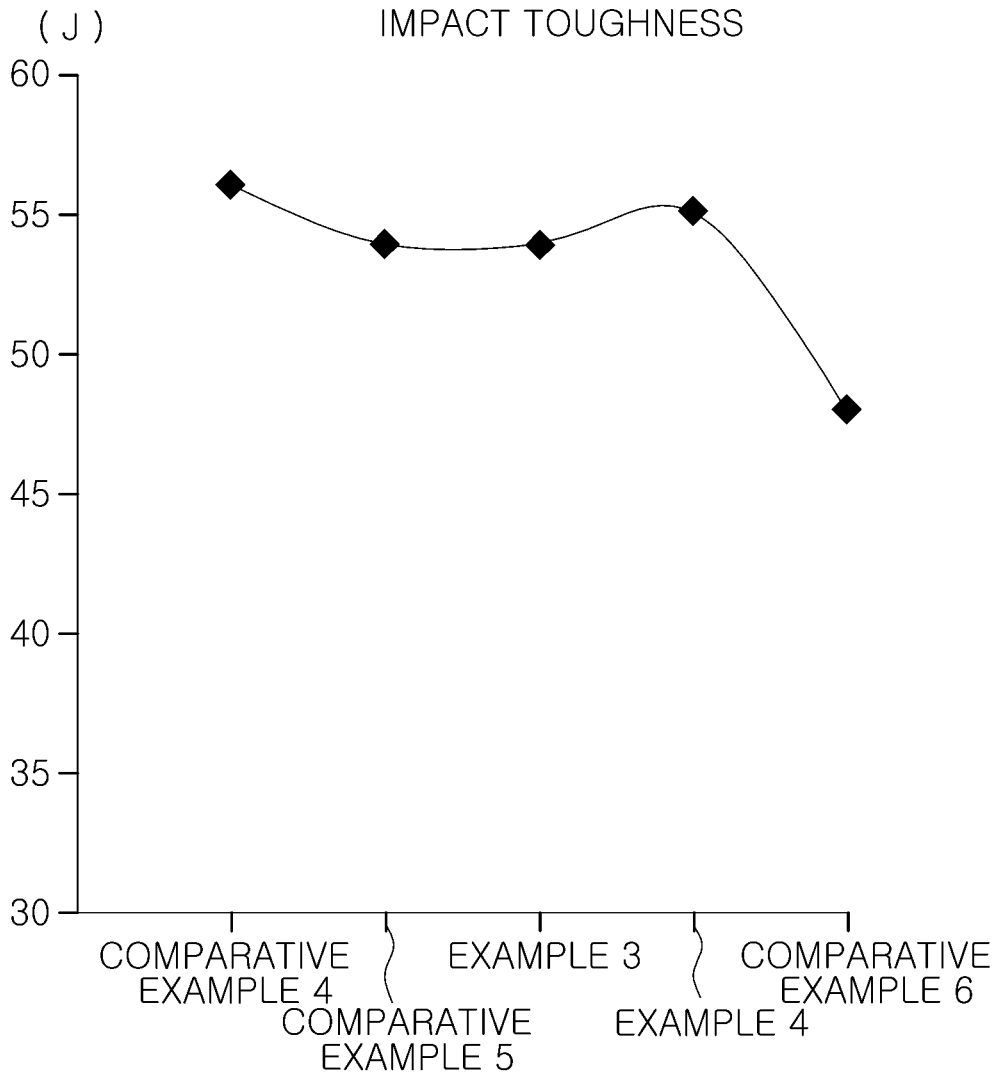
FIG. 8 is a graph showing an impact toughness of Examples according to an exemplary embodiment of the present invention and Comparative Examples dependent upon the content of manganese (Mn) of the present disclosure.
Figure 9:
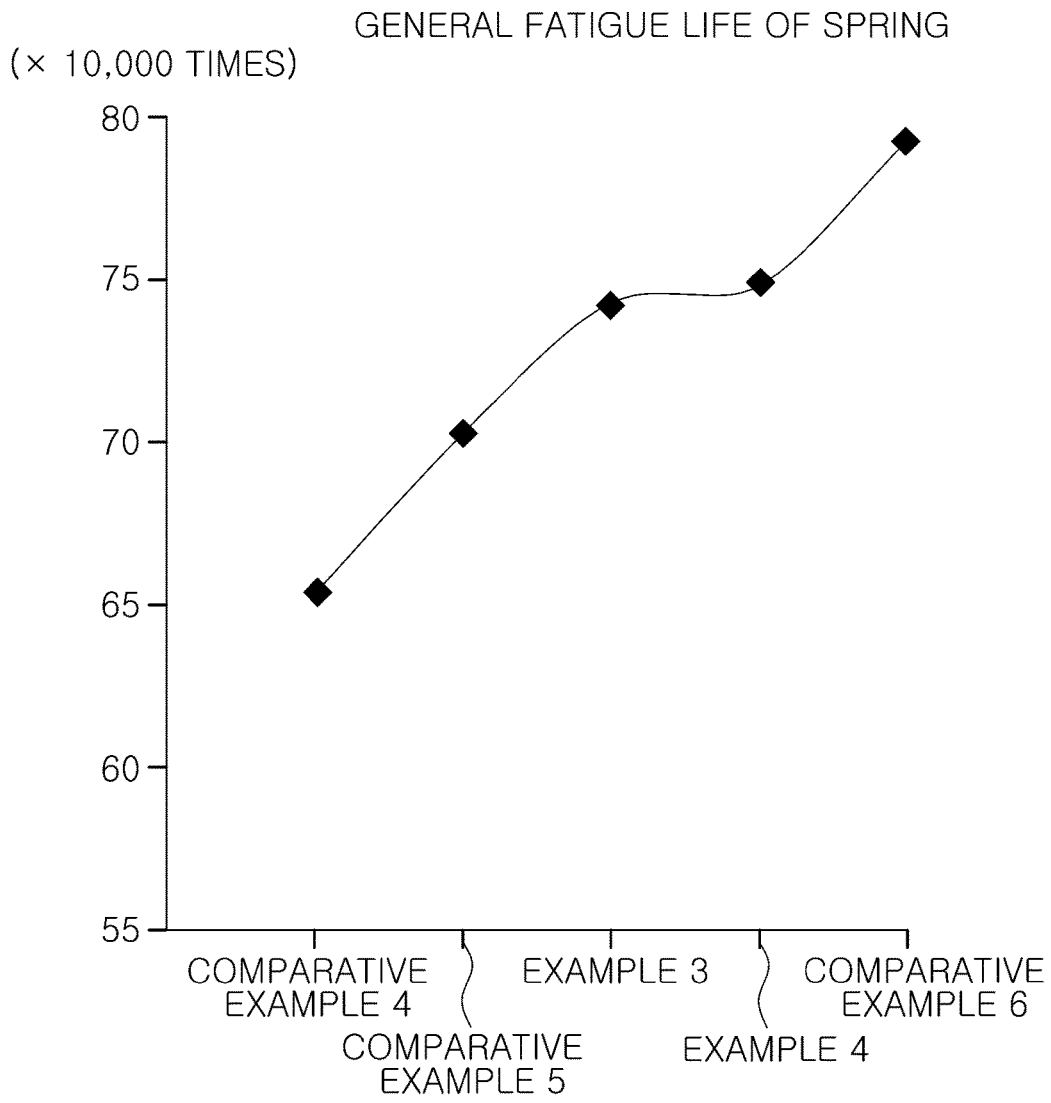
FIG. 9 is a graph showing a general fatigue life of coil springs from Examples according to an exemplary embodiment of the present invention and Comparative Examples dependent upon the content of manganese (Mn)

As illustrated in FIGS. 7 and 9, tensile strength and general fatigue life of a coil spring increased together with increasing manganese (Mn) content. However, as illustrated in FIG. 8, impact toughness was decreased with increasing manganese (Mn) content and, particularly, rapidly decreased from between 1.05% by weight and 1.17% by weight.

Figure 10:
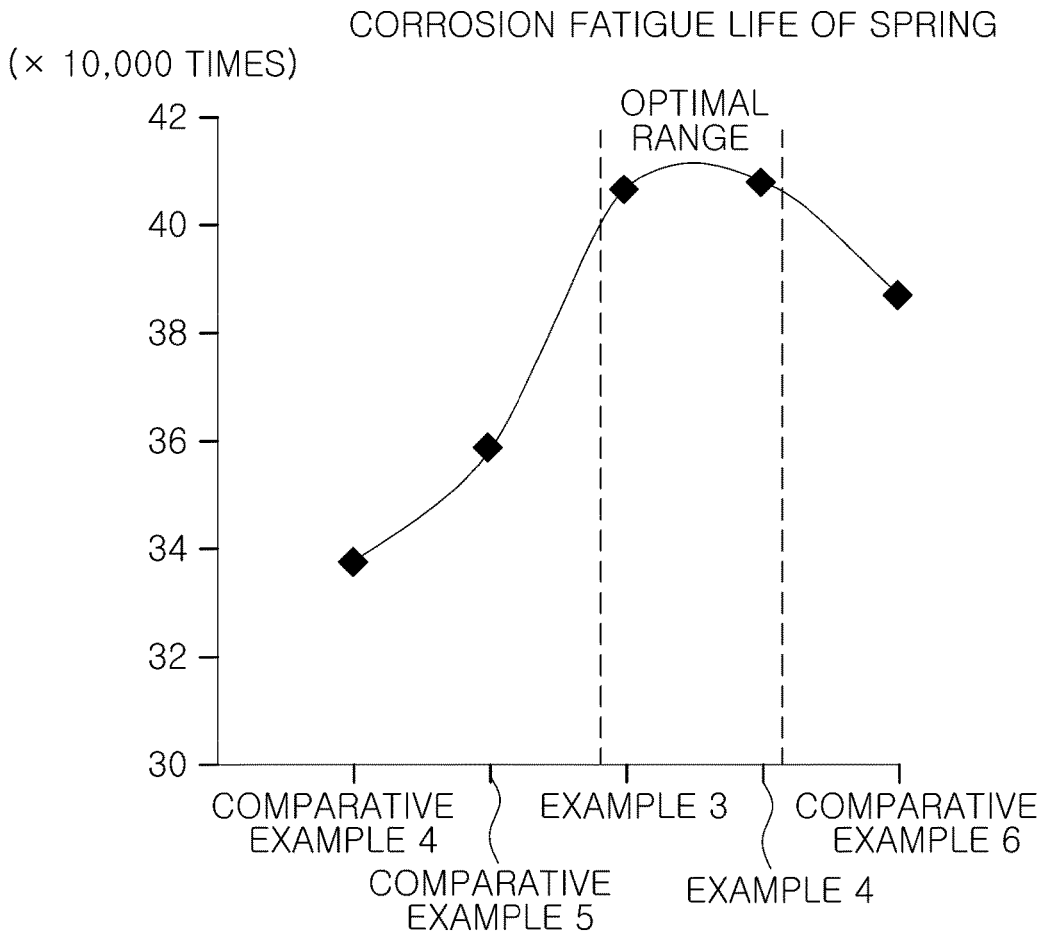
FIG. 10 is a graph showing a corrosion fatigue life of coil springs from Examples according to an exemplary embodiment of the present invention and Comparative Examples dependent upon the content of manganese (Mn)

As illustrated in FIG. 10, it can be confirmed that corrosion fatigue life of a spring was suitable in a manganese (Mn) content range of 0.95 to 1.05% by weight based on the total weight of the steel composition. Accordingly, corrosion fatigue life of the spring was also decreased in the range of 0.95% by weight to 1.05% by weight, in which impact toughness was rapidly decreased due to notch effects for a corroded groove.

Meanwhile, the pre-decarbonization and ferrite decarbonization depths were hardly affected by the content of manganese (Mn).

Effects according to control of the content of phosphorus (P) are discussed in detail and summarized in the following Table 3 and FIGS. 11 to 13 below.

TABLE 3

| | Classification | | | | | | | | |
|---|---|---|---|---|---|---|---|---|---|
| | Carbon (C) % by weight | Silicon (Si) % by weight | Manganese (Mn) % by weight | Chromium (Cr) % by weight | Copper (Cu) % by weight | Vanadium (V) % by weight | Nickel (Ni) % by weight | Phosphorus (P) % by weight | Sulfur (S) % by weight |
| Example 5 | 0.53 | 1.39 | 1.01 | 0.72 | 0.29 | 0.10 | 0.30 | 0.003 | 0.009 |
| Example 6 | 0.54 | 1.41 | 1.00 | 0.73 | 0.28 | 0.09 | 0.31 | 0.011 | 0.010 |
| Example 7 | 0.55 | 1.40 | 1.01 | 0.71 | 0.28 | 0.10 | 0.29 | 0.015 | 0.011 |
| Comparative Example 7 | 0.55 | 1.40 | 0.99 | 0.71 | 0.30 | 0.10 | 0.30 | 0.021 | 0.011 |
| Comparative Example 8 | 0.53 | 1.41 | 0.99 | 0.71 | 0.29 | 0.10 | 0.30 | 0.030 | 0.012 |

As summarized in Table 3, in comparative examples and examples, only phosphorus (P) was a control variable and the other elements were controlled in equal degrees, within a predetermined range, to components of the highly durable coil spring steel according to the present invention.

Since the content of phosphorus (P) was limited to 0.003 to 0.015% by weight, the contents of phosphorus (P) in Comparative Examples 7 and 8 were greater than 0.015% by weight.

Figure 11:
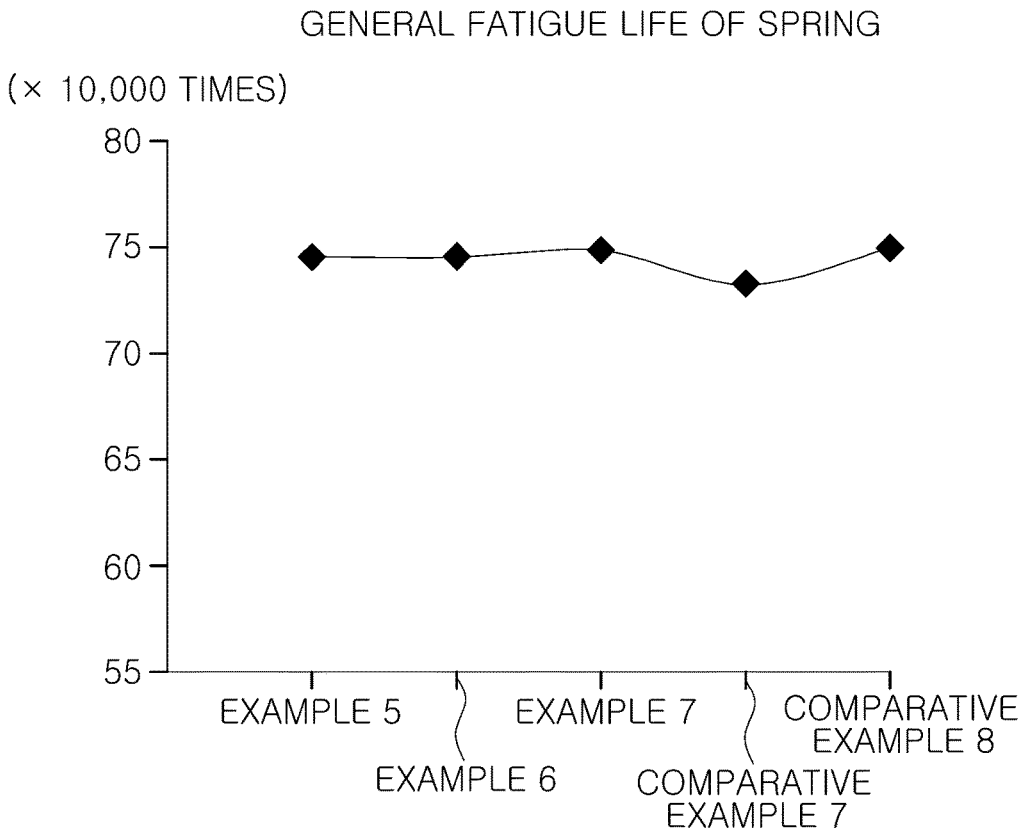
FIG. 11 is a graph showing a general fatigue life of coil springs from Examples according to an exemplary embodiment of the present invention and Comparative Examples dependent upon the content of phosphorus (P)

As illustrated in FIG. 11, the general fatigue life of coil spring was maintained at about 700,000 times or greater although the content of phosphorus (P) was increased. This means that control of the content of phosphorus (P) did not greatly affect general fatigue life of a coil spring.

Figure 12:
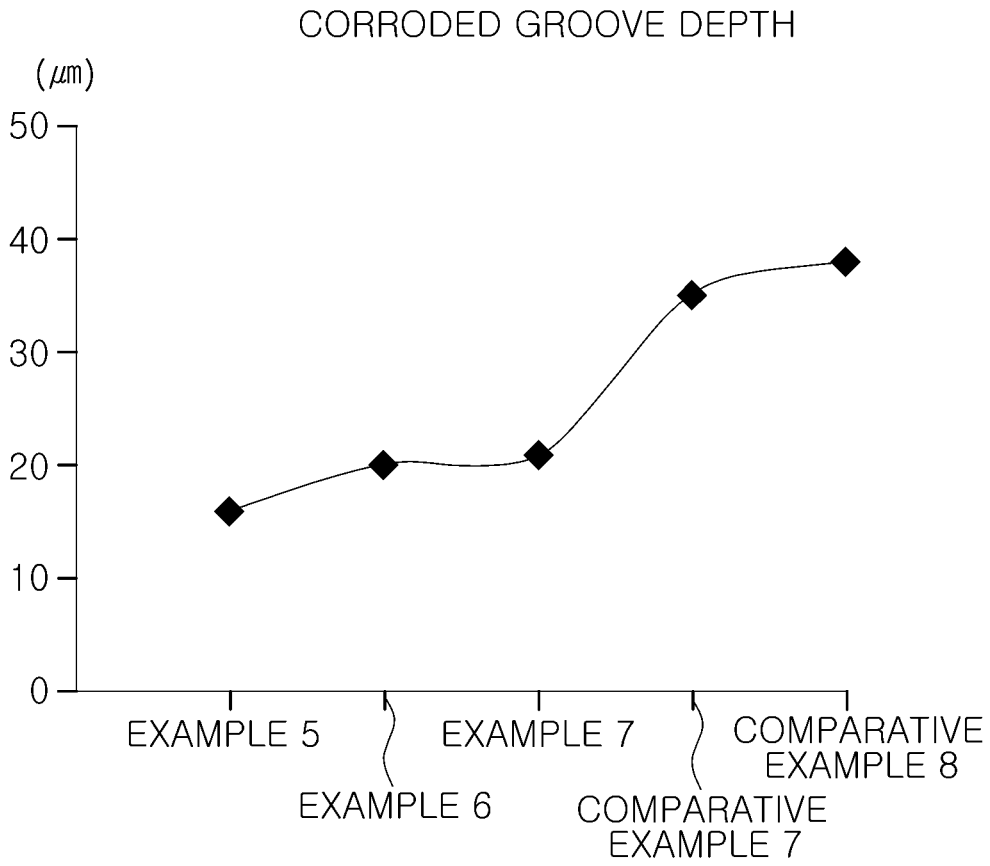
FIG. 12 is a graph showing depths of corroded grooves from Examples according to an exemplary embodiment of the present invention and Comparative Examples dependent upon the content of phosphorus (P)
Figure 13:
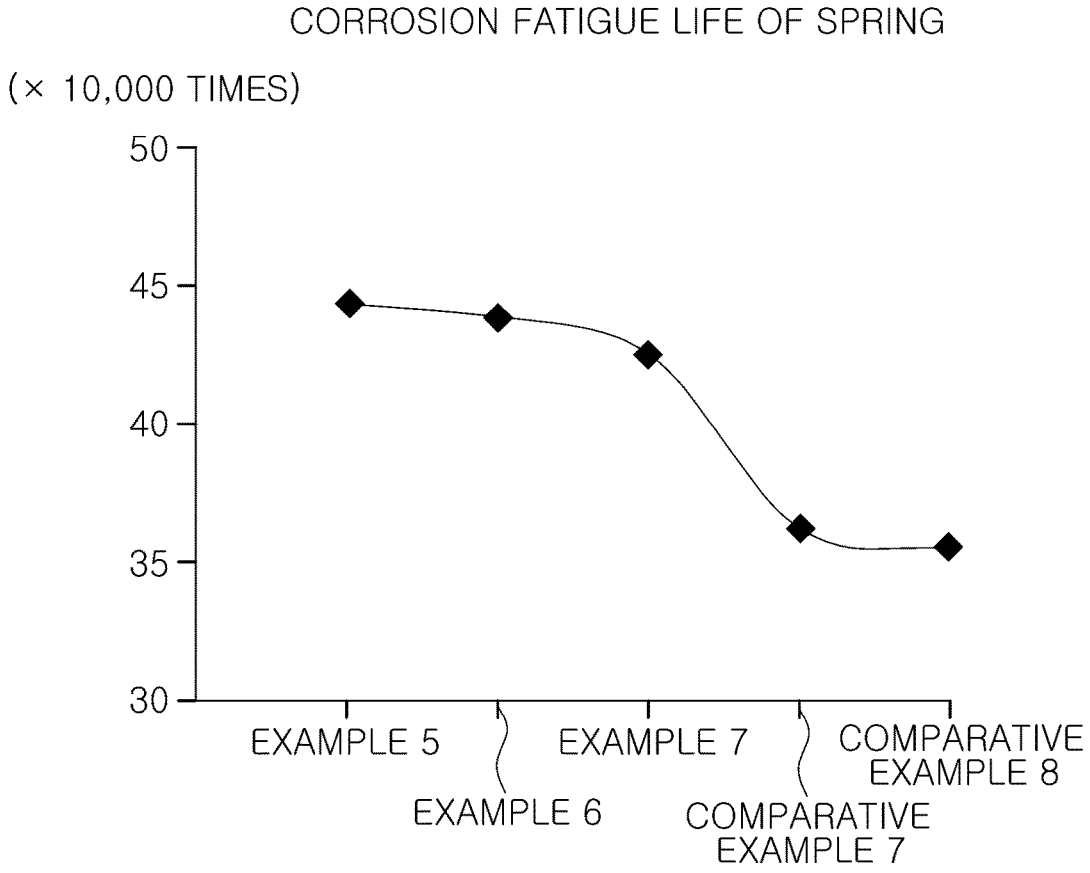
FIG. 13 is a graph showing a corrosion fatigue life of coil springs from Examples according to an exemplary embodiment of the present invention and Comparative Examples dependent upon the content of phosphorus (P)

On the other hand, as illustrated in FIGS. 12 and 13, it can be confirmed that the depth of corroded groove was deepened and the corrosion fatigue life of coil spring was decreased with increasing phosphorus (P) content. Furthermore, from a phosphorus (P) content range between 0.015% by weight and 0.021% by weight, the depth of corroded groove was rapidly deepened and the corrosion fatigue life of coil spring was rapidly decreased. This occurred because impact resistance was decreased and tempering brittleness was facilitated from when the content of phosphorus (P) was greater than the predetermined range.

Corrosion resistance dependent upon a corroded groove depth (μm) was evaluated by spraying an aqueous NaCl solution at a concentration of 5±0.5% at a temperature of 35° C. for 360 hours. Corrosion characteristics were superior with decreasing corroded groove depth.

For this reason, the content of phosphorus (P) may be in an amount of about 0.003 to 0.015% by weight based on the total weight of the steel composition.

Effects according to control of the content of sulfur (S) are discussed in detail below and summarized in the following Table 4 and FIGS. 11 to 13 below.

TABLE 4

| | Classification | | | | | | | | |
|---|---|---|---|---|---|---|---|---|---|
| | Carbon (C) % by weight | Silicon (Si) % by weight | Manganese (Mn) % by weight | Chromium (Cr) % by weight | Copper (Cu) % by weight | Vanadium (V) % by weight | Nickel (Ni) % by weight | Phosphorus (P) % by weight | Sulfur (S) % by weight |
| Example 8 | 0.53 | 1.39 | 0.99 | 0.70 | 0.28 | 0.12 | 0.28 | 0.010 | 0.003 |
| Example 9 | 0.52 | 1.39 | 1.00 | 0.72 | 0.30 | 0.11 | 0.28 | 0.011 | 0.005 |
| Example 10 | 0.52 | 1.38 | 1.00 | 0.72 | 0.30 | 0.11 | 0.29 | 0.009 | 0.010 |
| Comparative Example 9 | 0.53 | 1.41 | 0.99 | 0.71 | 0.28 | 0.12 | 0.28 | 0.008 | 0.021 |
| Comparative Example 10 | 0.54 | 1.40 | 1.00 | 0.73 | 0.29 | 0.10 | 0.29 | 0.010 | 0.029 |

As summarized in Table 4, only sulfur (S) was a control variable and the other elements were controlled in equal degrees, within a predetermined range, to components of the highly durable coil spring steel according to the present invention in comparative examples and examples.

Since the content of sulfur (S) was limited to 0.003 to 0.010% by weight, the contents of sulfur (S) in Comparative Examples 9 and 10 were greater than 0.010% by weight.

Figure 14:
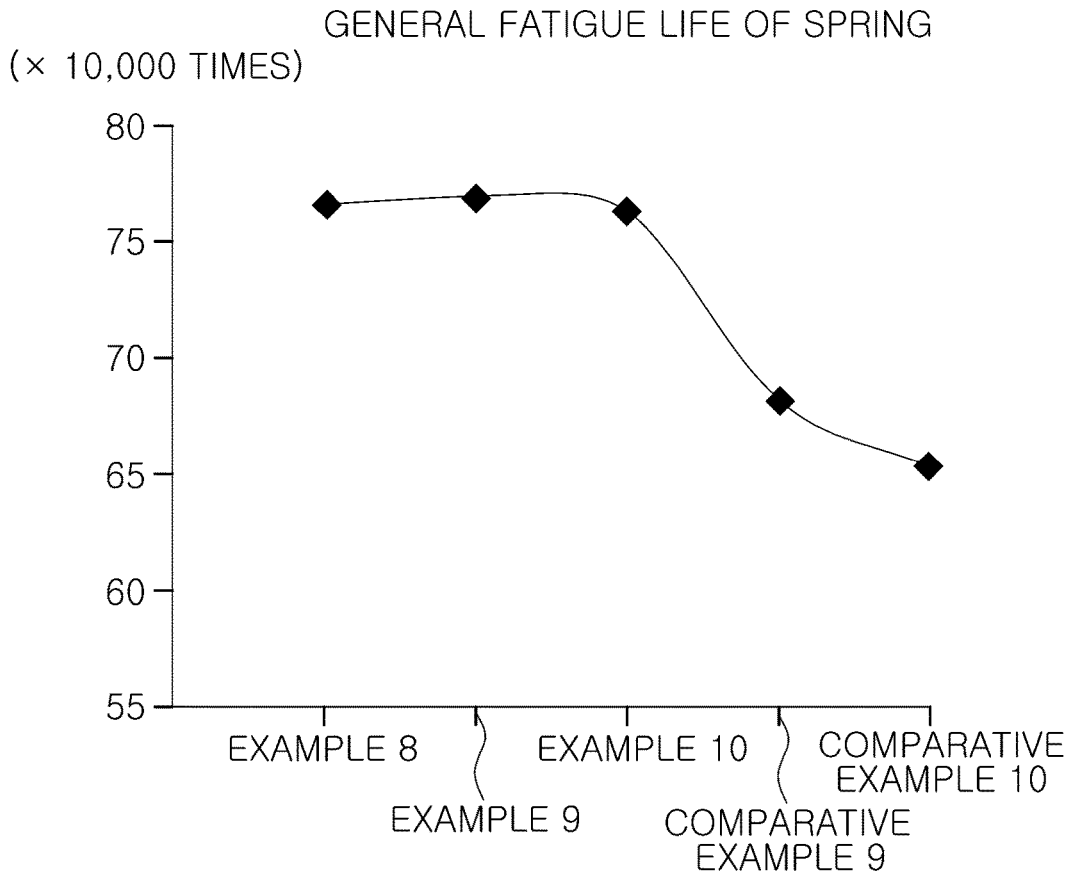
FIG. 14 is a graph showing a general fatigue life of coil springs from Examples according to an exemplary embodiment of the present invention and Comparative Examples dependent upon the content of sulfur (S)

As illustrated in FIG. 14, the general fatigue life of the coil spring was equally maintained at about 750,000 times although the content of sulfur (S) increased, but rapidly decreased from a sulfur (S) content range between 0.010% by weight to 0.021% by weight. This occurred because influence of an MnS inclusion increased when the content of sulfur (S) was greater than the predetermined range.

Figure 15:
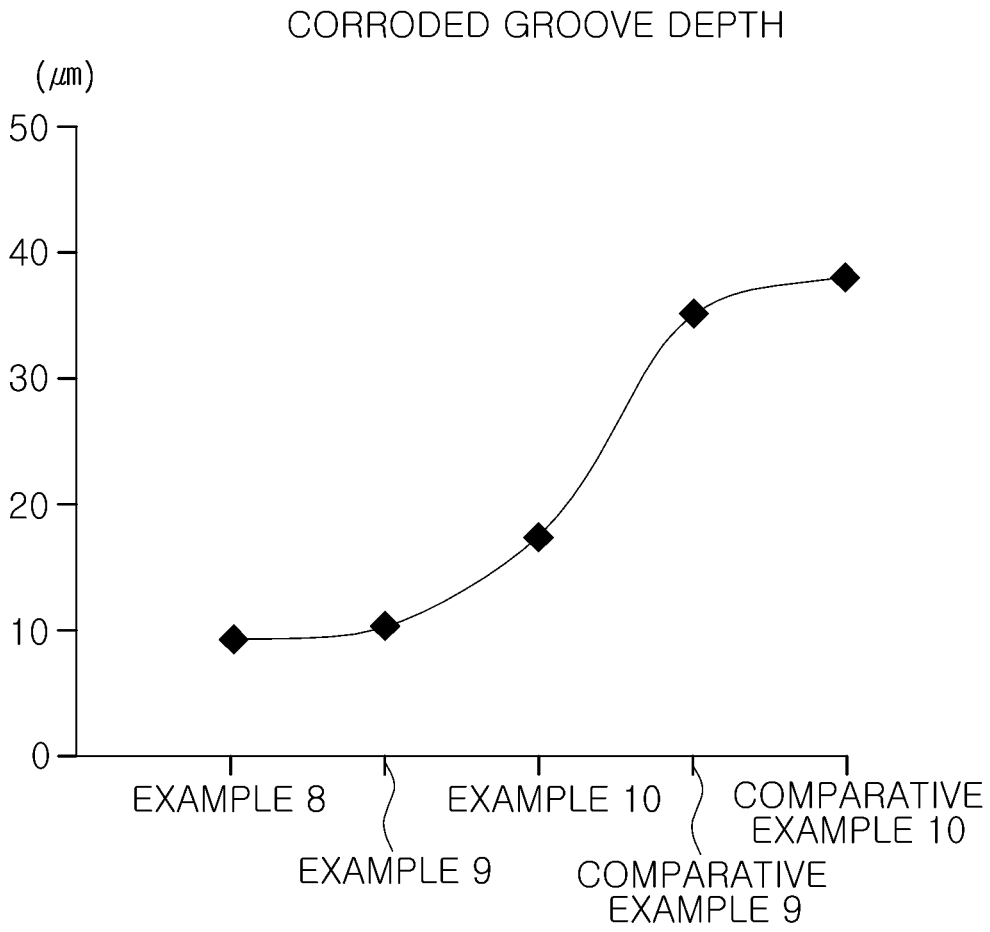
FIG. 15 is a graph showing depths of corroded grooves from Examples according to an exemplary embodiment of the present invention and Comparative Examples dependent upon the content of sulfur (S)
Figure 16:
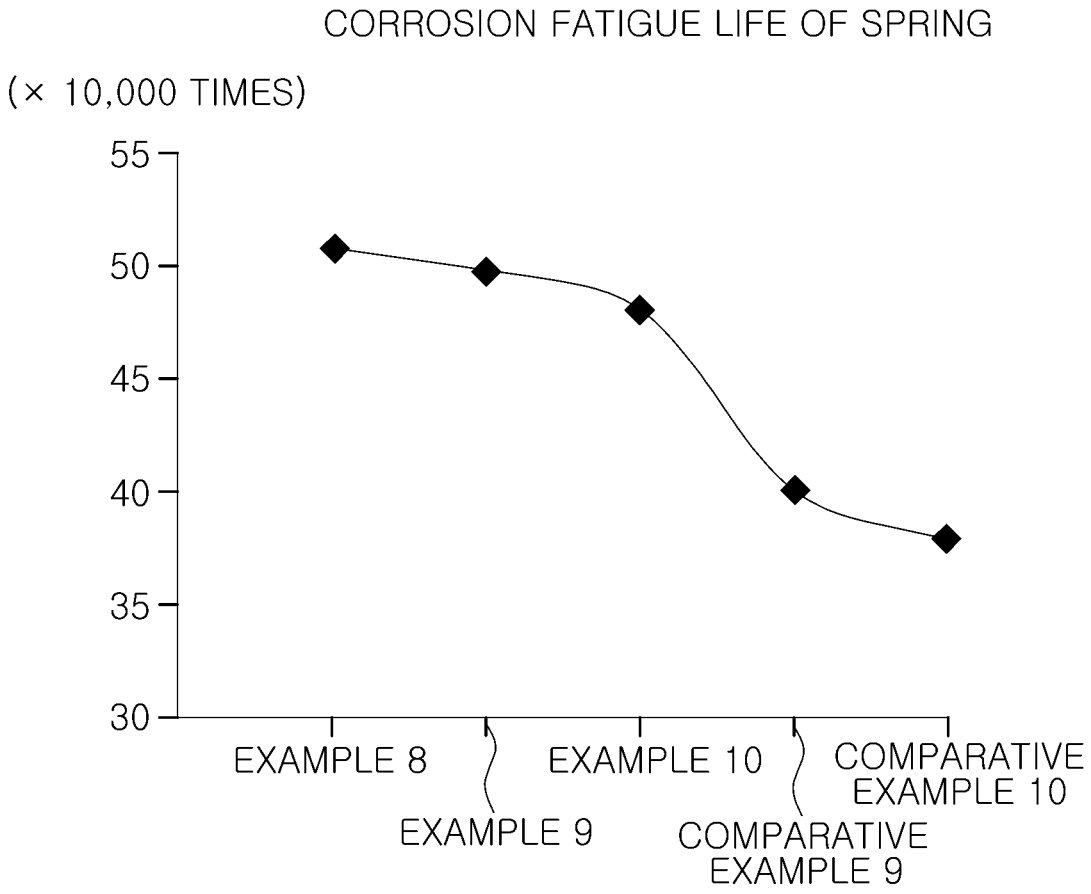
FIG. 16 is a graph showing a corrosion fatigue life of coil springs from Examples according to an exemplary embodiment of the present invention and Comparative Examples dependent upon the content of sulfur (S)

In addition, as illustrated in FIGS. 15 and 16, it can be confirmed that the depth of corroded groove was deepened and the corrosion fatigue life of coil spring was decreased with increasing sulfur (S) content. Furthermore, from a phosphorus (P) content range between 0.010% by weight and 0.021% by weight, the depth of corroded groove was rapidly deepened and corrosion fatigue life of coil spring was rapidly decreased. This occurred because impact resistance was decreased and tempering brittleness was facilitated from when the content of sulfur (S) was greater than the predetermined the range.

For this reason, the content of sulfur (S) may be in an amount of about 0.003 to 0.010% by weight based on the total weight of the steel composition.

It can be confirmed through the following Table 5 below and FIGS. 17 to 18 that the highly durable coil spring steel having the composition according to the present invention had superior properties, compared to the existing material, and the cases in which the contents of silicon (Si), manganese (Mn), phosphorus (P), sulfur (S), and the like were less or greater than those of the present invention.

TABLE 5

| | Classification | | | | | | | | |
|---|---|---|---|---|---|---|---|---|---|
| | Carbon (C) % | Silicon (Si) % | Manganese (Mn) % | Chromium (Cr) % | Copper (Cu) % | Vanadium (V) % | Nickel (Ni) % | Phosphorus (P) % | Sulfur (S) % |
| Existing material | 0.54 | 1.48 | 0.64 | 0.67 | 0.28 | 0.11 | 0.28 | 0.010 | 0.010 |
| Comparative Example 11 | 0.55 | 1.32 | 0.92 | 0.73 | 0.31 | 0.11 | 0.29 | 0.002 | 0.002 |
| Example 11 | 0.52 | 1.37 | 0.96 | 0.62 | 0.25 | 0.07 | 0.21 | 0.004 | 0.004 |
| Example 12 | 0.55 | 1.41 | 0.99 | 0.73 | 0.31 | 0.11 | 0.29 | 0.009 | 0.006 |
| Example 13 | 0.57 | 1.44 | 1.03 | 0.79 | 0.34 | 0.15 | 0.33 | 0.014 | 0.009 |
| Comparative Example 12 | 0.55 | 1.48 | 1.08 | 0.73 | 0.31 | 0.11 | 0.29 | 0.018 | 0.015 |

Figure 17:
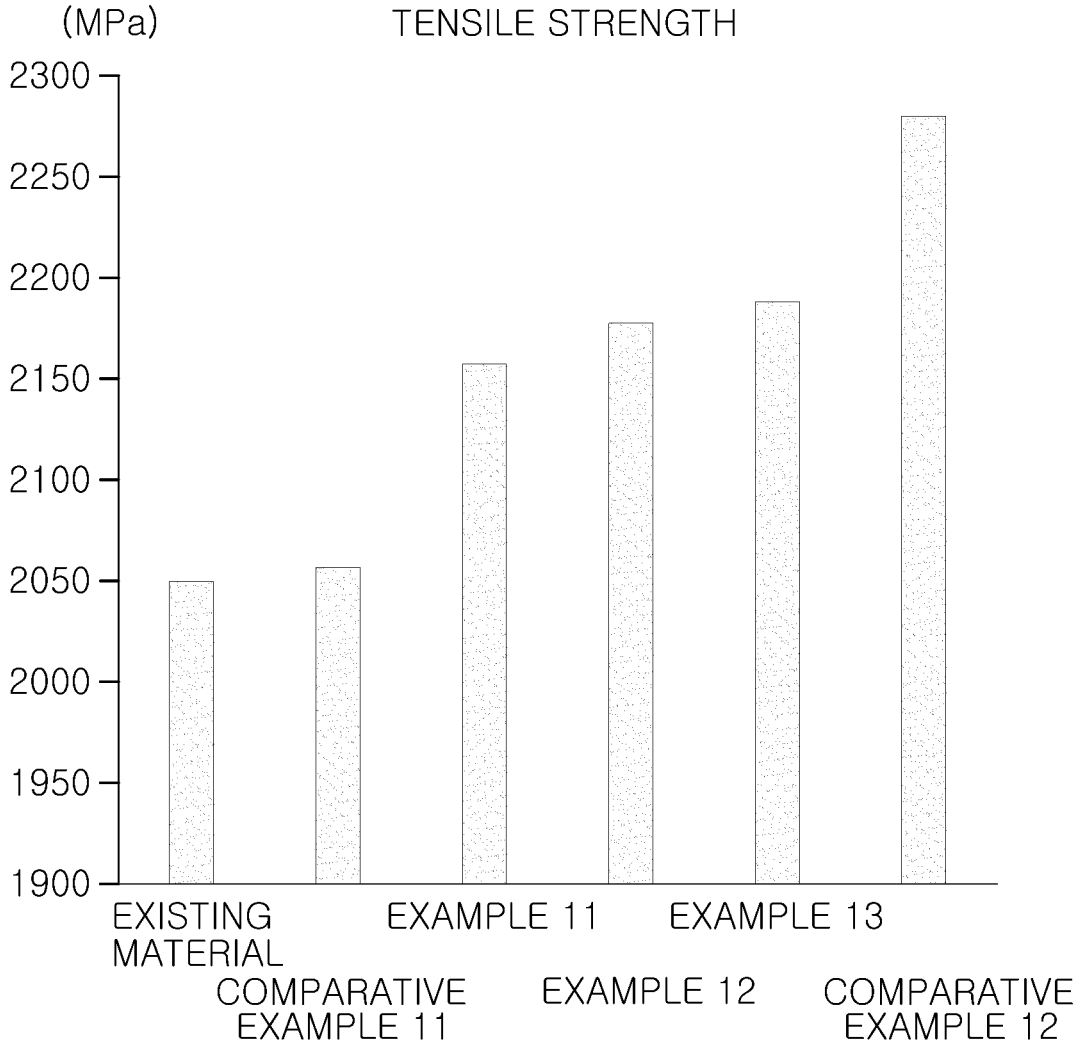
FIG. 17 is a graph showing a tensile strength of Examples according to an exemplary embodiment of the present invention, Comparative Examples, and conventional (existing) material.
Figure 18:
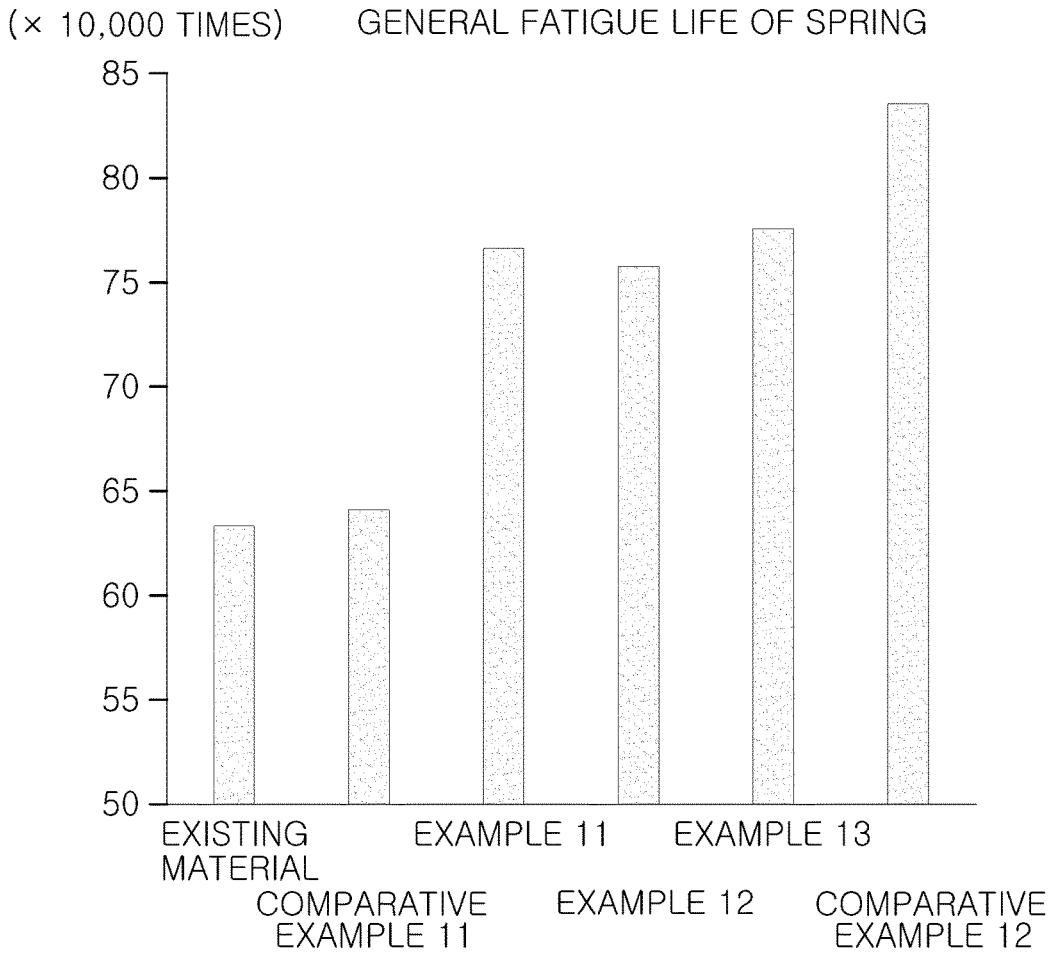
FIG. 18 is a graph showing a general fatigue life of coil springs from Examples according to an exemplary embodiment of the present invention, Comparative Examples, and conventional (existing) material.
Figure 19:
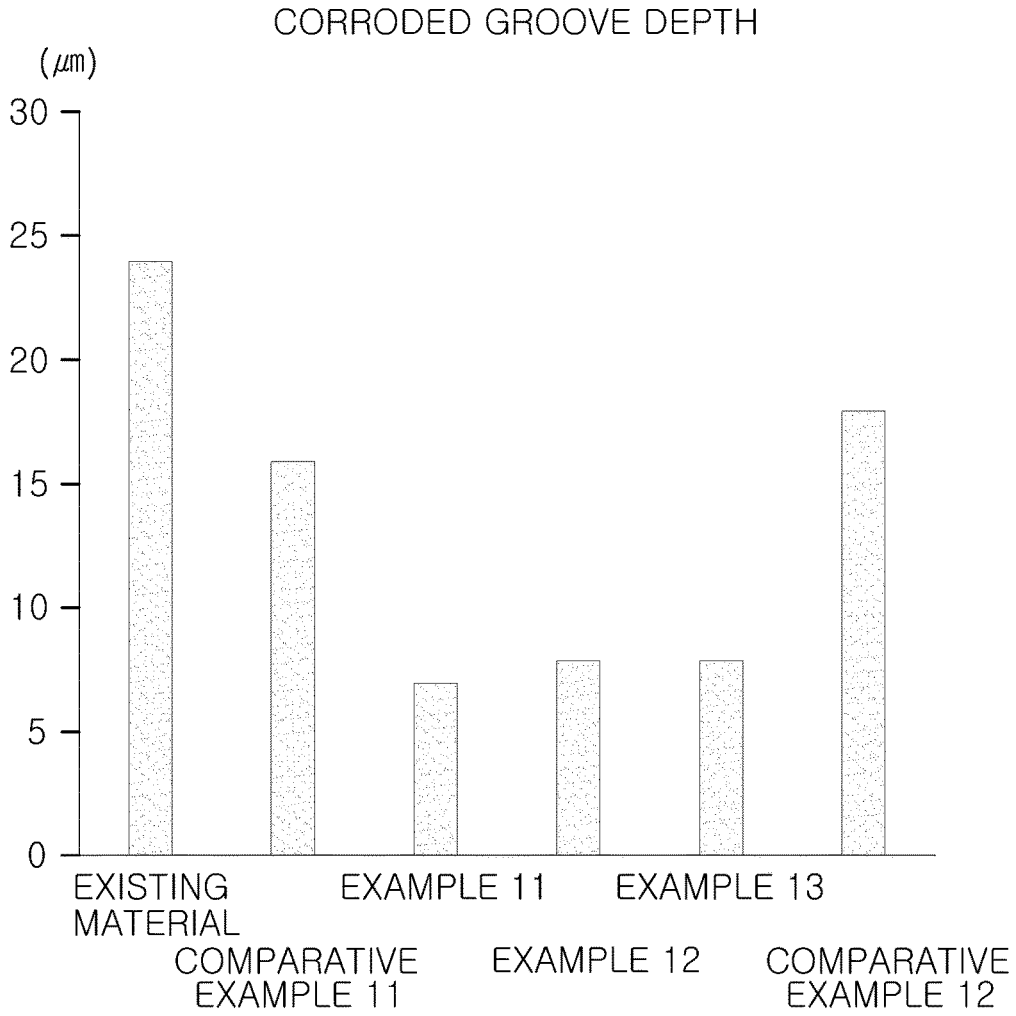
FIG. 19 is a graph showing depths of corroded grooves of examples of Examples according to an exemplary embodiment of the present invention, Comparative Examples, and conventional (existing) material.
Figure 20:
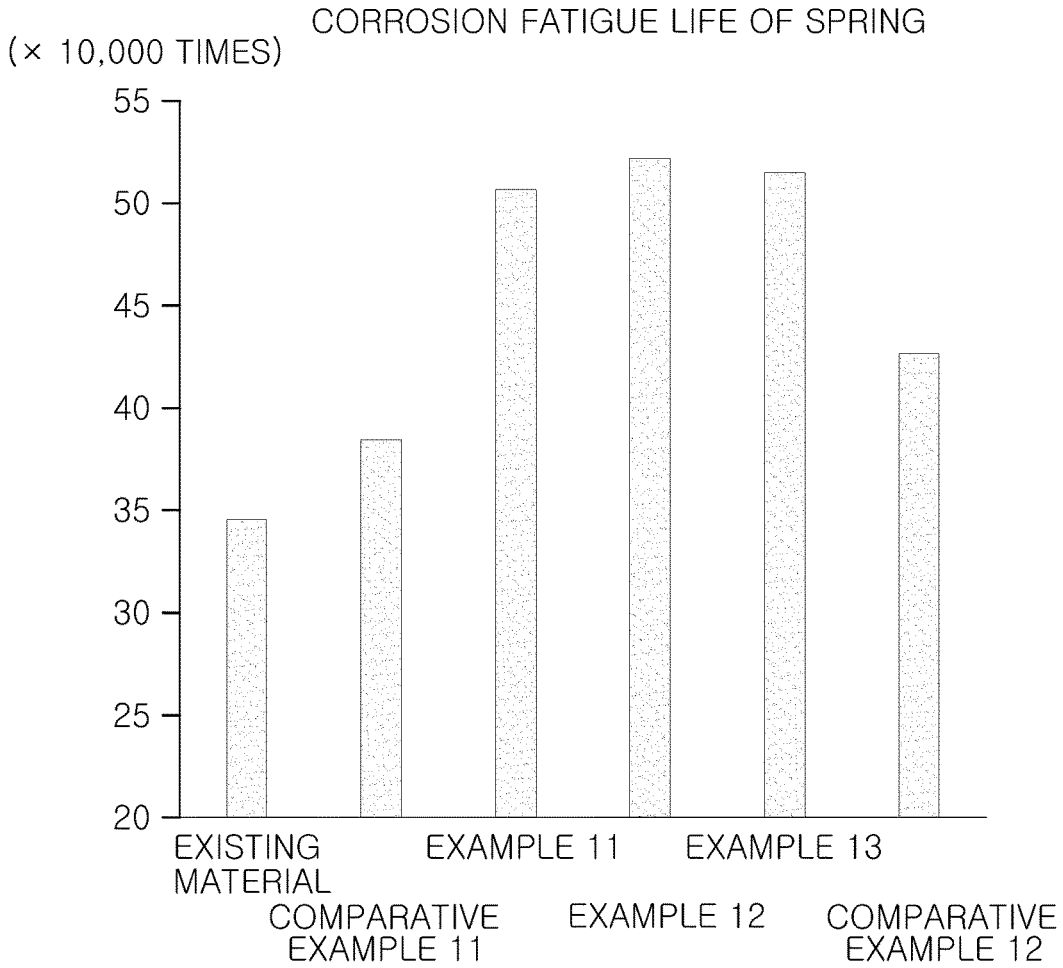
FIG. 20 is a graph showing corrosion fatigue life of coil springs from Examples according to an exemplary embodiment of the present invention, Comparative Examples, and conventional (existing) material.

As illustrated in FIGS. 17 and 18, tensile strength was 2100 to 2200 MPa which was about 5% greater than 2050 MPa of the existing material.

Due to the increased tensile strength, the weight per existing coil spring may be decreased up to from 3 kg to 3.24 kg and thus weight reduction of about 15% may be accomplished.

The general fatigue life of the coil spring steel was up to 760,000 times which was about 20% greater than 630,000 times of the existing material. In addition, a minimum depth of corroded groove was 7 μm which was about 70% less than 24 μm of the existing material. In addition, it can be confirmed that the corrosion fatigue life of the coil spring steel was up to 508,000 times which was about 45% greater than 348,000 times of the existing material.

Accordingly, while the existing material requires a urethane hose or the like as a mean for complementing corrosion resistance, the highly durable coil spring steel according to the present invention may not require an additional urethane hose or the like due to enhanced corrosion resistance, which causes production cost reduction.

As described above, the highly durable coil spring steel according to various exemplary embodiments of the present invention may exhibit increased tensile strength and corrosion resistance, whereby durability increase may be anticipated.

(Manufacturing Method)

A steel material including 0.51 to 0.57% by weight of carbon (C), 1.35 to 1.45% by weight of silicon (Si), 0.95 to 1.05% by weight of manganese (Mn), 0.60 to 0.80% by weight of chromium (Cr), 0.25 to 0.35% by weight of copper (Cu), 0.05 to 0.15% by weight of vanadium (V), 0.25 to 0.35% by weight of nickel (Ni), 0.003 to 0.015% by weight of phosphorus (P), 0.003 to 0.010% by weight of sulfur (S), and a remainder of iron (Fe) and other unavoidable impurities was subjected to wire processing and a filling process.

Subsequently, a resultant wire was subjected to a controlled heat treatment process in which the wire was maintained at a constant high temperature for a constant time and then air-cooled to refine crystal grains of the wire and homogenize tissue. This controlled heat treatment process was maintained at a temperature of about 950 to 1000° C. for four to six minutes to minimize hardness decrease of the outermost surface. Subsequently, quenching and tempering were performed to provide strength and toughness to a resultant homogenized wire. As a result, a highly durable coil spring was produced.

As demonstrated in the above results, the highly durable coil spring steel of the present invention may have increased corrosion resistance as including suitable contents of silicon (Si), manganese (Mn), phosphorus (P), and sulfur (S) and, thus may have, increased durability. In addition, since the highly durable coil spring steel has increased tensile strength, the weight of the coil spring may be reduced, and thus, fuel efficiencies of vehicles may be increased.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A coil spring steel comprising a steel composition, wherein the steel composition comprises:

an amount of about 0.51 to 0.57% by weight of carbon (C), an amount of about 1.35 to 1.45% by weight of silicon (Si), an amount of about 0.95 to 1.05% by weight of manganese (Mn), an amount of about 0.60 to 0.80% by weight of chromium (Cr), an amount of about 0.25 to 0.35% by weight of copper (Cu), an amount of about 0.05 to 0.15% by weight of vanadium (V), an amount of about 0.25 to 0.35% by weight of nickel (Ni), an amount of about 0.003 to 0.015% by weight of phosphorus (P), an amount of about 0.003 to 0.010% by weight of sulfur (S), and iron (Fe) constituting the remaining balance of the steel composition, all the % by weights based on the total weight of the steel composition, wherein the coil spring steel has a general fatigue life of about 750,000 or greater under a repeated stress condition of up to about 120 kgf/mm$^2$ when subjected to a general fatigue life test after molding of a spring, wherein the coil spring steel has a corrosion fatigue life of about 500,000 times or greater under conditions of salt water-spraying and a repeated stress of up to about 60 kgf/mm$^2$ when subjected to a corrosion fatigue life test after molding of a spring.

2. The coil spring steel of claim 1, wherein the steel composition consists essentially of:

an amount of about 0.51 to 0.57% by weight of carbon (C), an amount of about 1.35 to 1.45% by weight of silicon (Si), an amount of about 0.95 to 1.05% by weight of manganese (Mn), an amount of about 0.60 to 0.80% by weight of chromium (Cr), an amount of about 0.25 to 0.35% by weight of copper (Cu), an amount of about 0.05 to 0.15% by weight of vanadium (V), an amount of about 0.25 to 0.35% by weight of nickel (Ni), an amount of about 0.003 to 0.015% by weight of phosphorus (P), an amount of about 0.003 to 0.010% by weight of sulfur (S), and iron (Fe) constituting the remaining balance of the steel composition, all the % by weights based on the total weight of the steel composition.

3. The coil spring steel of claim 1, wherein the steel composition consists of:

an amount of about 0.51 to 0.57% by weight of carbon (C), an amount of about 1.35 to 1.45% by weight of silicon (Si), an amount of about 0.95 to 1.05% by weight of manganese (Mn), an amount of about 0.60 to 0.80% by weight of chromium (Cr), an amount of about 0.25 to 0.35% by weight of copper (Cu), an amount of about 0.05 to 0.15% by weight of vanadium (V), an amount of about 0.25 to 0.35% by weight of nickel (Ni), an amount of about 0.003 to 0.015% by weight of phosphorus (P), an amount of about 0.003 to 0.010% by weight of sulfur (S), and iron (Fe) constituting the remaining balance of the steel composition, all the % by weights based on the total weight of the steel composition.

4. The coil spring steel of claim 1, wherein the coil spring steel has an outermost-surface ferrite decarbonization depth of about 1 μm or less after molding of a spring.

5. A vehicle part comprising a coil spring steel of claim 1.

6. A vehicle that comprises a vehicle part of claim 5.

7. The coil spring steel of claim 1, wherein the steel composition comprises:

an amount of about 0.52 to 0.57% by weight of carbon (C), an amount of about 1.37 to 1.44% by weight of silicon (Si), an amount of about 0.96 to 1.03% by weight of manganese (Mn), an amount of about 0.62 to 0.79% by weight of chromium (Cr), an amount of about 0.25 to 0.34% by weight of copper (Cu), an amount of about 0.07 to 0.15% by weight of vanadium (V), an amount of about 0.29 to 0.33% by weight of nickel (Ni), an amount of about 0.004 to 0.014% by weight of phosphorus (P), an amount of about 0.004 to 0.009% by weight of sulfur (S), and iron (Fe) constituting the remaining balance of the steel composition, all the % by weights based on the total weight of the steel composition.

* * * * *